US005967120A

United States Patent [19]

Blanton et al.

[11] Patent Number: 5,967,120

[45] Date of Patent: Oct. 19, 1999

[54] RETURNLESS FUEL DELIVERY SYSTEM

[75] Inventors: Brian Michael Blanton, Dearborn; Robert Eugene Wattleworth, Canton; Glen Paul Langenderfer, Temperance; Alvin Arthur Powell, Corunna; James Witherspoon Mitchell, Jr., Wayne, all of Mich.

[73] Assignee: Ford Global Technologies, Inc., Dearborn, Mich.

[21] Appl. No.: 08/585,678

[22] Filed: Jan. 16, 1996

[51] Int. Cl.[6] ..... F02M 41/00

[52] U.S. Cl. ..... 123/467; 123/514; 137/510

[58] Field of Search ..... 123/463, 467, 123/456, 447, 514; 137/510, 563, 569

[56] References Cited

U.S. PATENT DOCUMENTS

| | | | |
|---|---|---|---|
| 3,827,409 | 8/1974 | O'Neill . | |
| 3,967,598 | 7/1976 | Rachel . | |
| 4,205,637 | 6/1980 | Ito et al. . | |
| 4,357,921 | 11/1982 | Ciaccio et al. . | |
| 4,562,816 | 1/1986 | Dorr . | |
| 4,615,320 | 10/1986 | Fehrenbach et al. . | |
| 4,741,315 | 5/1988 | Fehrenbach | 123/467 |
| 4,834,132 | 5/1989 | Sasaki | 123/514 |
| 5,163,472 | 11/1992 | Takada | 123/447 |
| 5,394,900 | 3/1995 | Okuyama | 123/463 |
| 5,398,655 | 3/1995 | Tuckey . | |
| 5,413,017 | 5/1995 | Hornby | 123/463 |
| 5,456,233 | 10/1995 | Felhofer | 123/456 |
| 5,509,390 | 4/1996 | Tuckey | 123/463 |
| 5,520,215 | 5/1996 | Haboush | 123/467 |

FOREIGN PATENT DOCUMENTS

| | | |
|---|---|---|
| 2538502 | 7/1983 | France . |
| 2357790 | 5/1974 | Germany . |

*Primary Examiner*—Carl S. Miller
*Attorney, Agent, or Firm*—Mark S. Sparschu

[57] ABSTRACT

In one embodiment of the present invention, a "returnless" fuel delivery system for a motor vehicle includes a fuel pressure regulator located in the fuel tank and a fuel pressure damper located at the fuel rail on the vehicle's engine. The fuel return line from the fuel rail to the fuel tank, a conventional feature in fuel delivery systems, is eliminated. Fuel delivery systems according to the present invention can provide very precise fuel delivery at a highly competitive system cost.

16 Claims, 2 Drawing Sheets

RETURNLESS FUEL DELIVERY SYSTEM

BACKGROUND OF THE INVENTION

1. Field of the Invention

The present invention relates to fuel delivery systems for motor vehicles.

2. Description of the Related Art

In the continuing effort to reduce evaporative emissions from motor vehicles, "returnless" fuel systems are seen as a promising way to do so. A conventional fuel system has a fuel line connecting a fuel pump with a fuel rail on the engine of the motor vehicle. Connected to the fuel rail are one or more fuel injectors. A second fuel line runs from a bypass fuel pressure regulator on the fuel rail to the fuel tank of the motor vehicle to return unused fuel to the fuel tank. This fuel that returns to the fuel tank has often been heated by the heat of the engine, by exhaust heat and by heat from the underbody of the vehicle. One disadvantageous result from an emissions standpoint is the accumulation of fuel vapor in the fuel tank due to the return of heated fuel.

Returnless fuel systems eliminate the fuel line which returns fuel from the fuel rail to the fuel tank. Instead, the fuel system is designed to supply the proper amount of fuel to the fuel rail, so there is no excess.

One proposed returnless fuel system is disclosed in U.S. Pat. No. 5,044,344, issued to Tuckey et al. In this system, the speed of a fuel pump motor is controlled in accordance with feedback from a fuel pressure sensor. Although such a system may generally be effective, alternative systems may be more economical than an electronic system. Further, other systems may be able to respond more quickly to transient conditions than a system which operates based on controlling the speed of a fuel pump.

SUMMARY OF THE INVENTION

The present invention provides a fuel delivery system for a motor vehicle. The system comprises a fuel pump, at least one fuel injector and fuel delivery passage means for delivering fuel provided by the fuel pump to the at least one fuel injector. In addition, the system includes a fuel pressure regulator coupled to the fuel delivery passage means and a fuel pressure damper coupled to the fuel delivery passage means downstream of the fuel pressure regulator.

The present invention also provides a second fuel delivery system for a motor vehicle. This system comprises a fuel tank, a fuel pump located within the fuel tank, at least one fuel injector and fuel delivery passage means for delivering fuel provided by the fuel pump to the at least one fuel injector. The system also includes a fuel bypass passage coupled to the fuel delivery passage means and terminating within the fuel tank. Additionally, the system comprises a fuel pressure damper coupled in communication with the fuel delivery passage means downstream of where the fuel bypass passage is coupled to the fuel delivery passage means.

Fuel delivery systems according to this invention can perform very precise fuel delivery at an extremely competitive system cost. In doing so, this invention provides advantages over the prior art.

DETAILED DESCRIPTION OF THE PREFERRED EMBODIMENT

Figure 1:
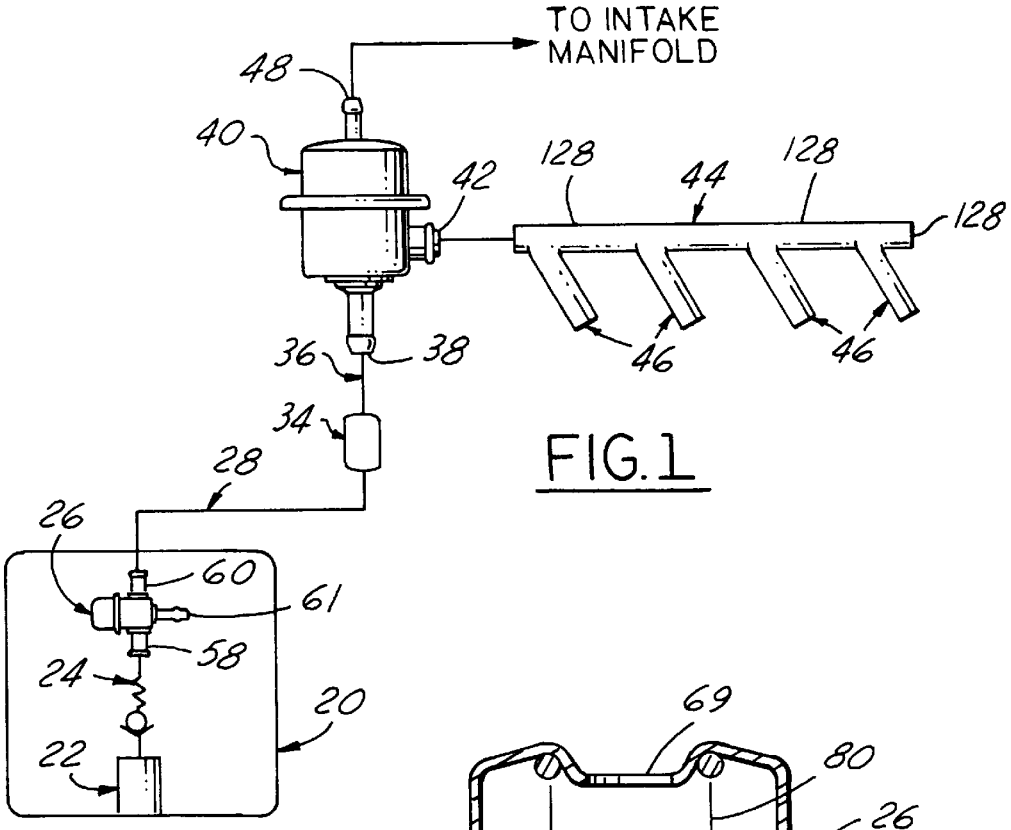
FIG. 1 is a diagram of a fuel delivery system according to one embodiment of the present invention.

Referring first to FIG. 1, a fuel delivery system according to one embodiment of the present invention will be described. The system includes a fuel tank 20, within which is an electrical fuel pump 22. Fuel pump 22 is preferably switchably coupled to a substantially constant source of voltage (nominally 12 volts) for operation at a substantially constant speed. Coupled at the outlet of fuel pump 22 is a check valve 24. Check valve 24 is preferably of the simple "ball and spring" variety, and may be integrated within fuel pump 22. After check valve 24 is coupled a fuel pressure regulator 26. This fuel pressure regulator 26 is a "bypass fuel pressure regulator". That is, fuel pressure regulator 26 regulates the pressure in fuel line 28 by bypassing into fuel tank 20 a sufficient portion of the fuel delivered by fuel pump 22.

The system further includes an in-line fuel filter 34 and a fuel line 36. Coupled to fuel line 36 is the inlet 38 of a fuel pressure damper 40. The outlet 42 of fuel pressure damper 40 is coupled to fuel rail 44, which contains at least one fuel injector 46. Port 48 of fuel pressure damper 40 is coupled to the intake manifold (not shown) of the engine. It can be seen that fuel line 28, fuel line 36 and fuel rail 44 together form a fuel delivery passage from fuel pump 22 to at least one fuel injector 46.

Figure 2:
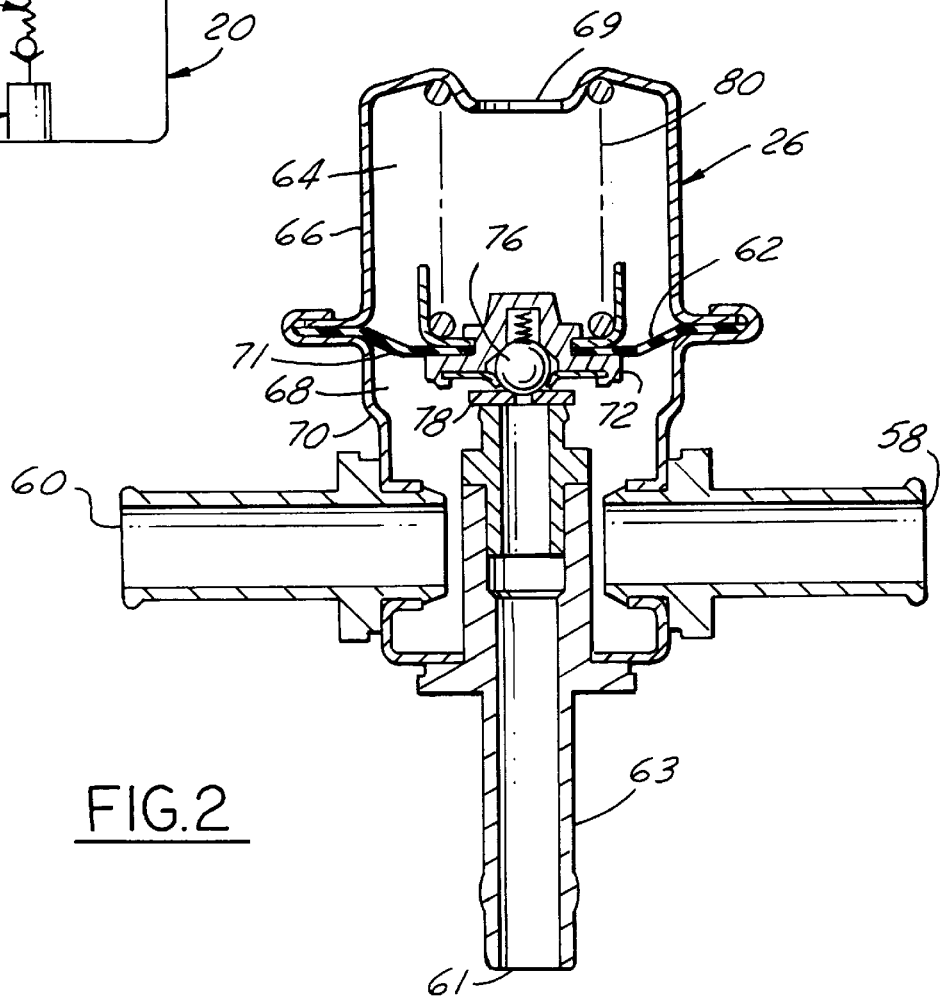
FIG. 2 is a cross-sectional view of fuel pressure regulator 26 of FIG. 1.

Fuel pressure regulator 26 is described more fully with additional reference to FIG. 2. Fuel pressure regulator 26 includes an inlet 58, a pressure-regulated outlet 60 and a bypass outlet 61. Bypass outlet 61 is at an end of a bypass passage 63. A diaphragm assembly 62 defines an upper chamber 64 in cooperation with upper housing 66 and a lower chamber 68 in cooperation with lower housing 70. Upper chamber 64 has an opening 69. Diaphragm assembly 62 comprises a flexible diaphragm 71, the periphery of which is crimped between upper housing 66 and lower housing 70. Body 72 carries a valve which comprises ball 76 attached to stopper 78. Stopper 78 is biased downward by main spring 80.

Fuel can flow freely between inlet 58 and pressure-regulated outlet 60. When the fuel pressure in lower chamber 68 rises sufficiently, the fuel pressure causes stopper 78 to lift off the top of bypass passage 63. A portion of the fuel supplied by fuel pump 22 can thus flow out of bypass outlet 61, regulating the fuel pressure at pressure-regulated outlet 60.

Because fuel pressure regulator 26 is preferably located within fuel tank 20 (to minimize the number of fuel lines which run between the interior and exterior of fuel tank 20), the entirety of fuel pressure regulator 26 should be constructed of suitable fuel-resistant materials.

Figure 3:
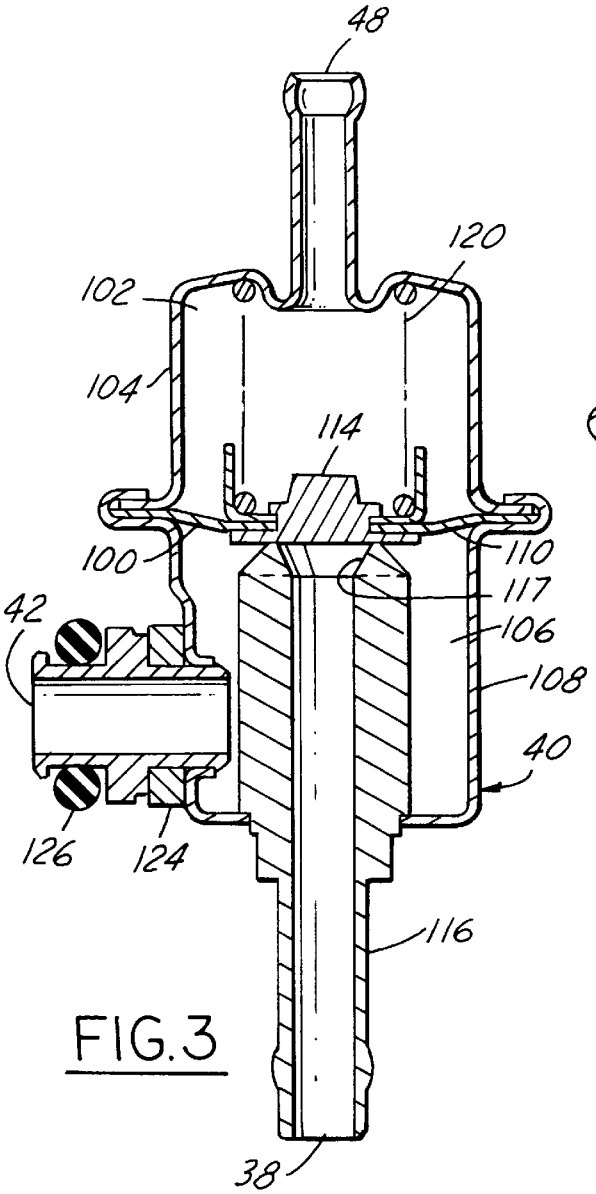
FIG. 3 is a cross-sectional view of fuel pressure damper 40 of FIG. 1.

Fuel pressure damper 40 is described in further detail with additional reference to FIG. 3. Fuel pressure damper 40 includes a diaphragm assembly 100 which defines an upper chamber 102 in cooperation with upper housing 104 and a lower chamber 106 in cooperation with lower housing 108. Diaphragm assembly 100 includes a flexible diaphragm 110, the periphery of which is crimped between upper housing 104 and lower housing 108. Diaphragm assembly 100 further includes body 114, which is disposed opposite the top of an inlet tube 116. When body 114 is resting on the top of inlet tube 116, fuel can flow from inlet 38, through inlet tube 116, beyond bevel 117, into lower chamber 106 and out of outlet 42.

Main spring 120 biases body 114 downward toward the top of inlet tube 116. Main spring 120 is selected such that for the nominal operational pressure of this system, main spring 120 is compressed roughly halfway. Further, fuel pressure damper 40 is designed such that for the normal operational pressure range of the system, including excursions such as fuel pressure pulsations caused by the opening and closing of fuel injectors 46, main spring 120 is neither fully compressed nor extended to the point where body 114 contacts inlet tube 116. That is, for the normal operational pressure range of this system, main spring 120 is able to dampen both positive and negative transient fuel pressure excursions.

Fuel pressure damper 40 mounts to fuel rail 44 via a mounting plate 124, which has appropriate holes (not shown in the cross-sectional view of FIG. 3) for bolts to attach damper 40 to fuel rail 44. O-ring 126 prevents fuel leakage from the joint between fuel pressure damper 40 and fuel rail 44.

Refer now to FIG. 1. The present system operates as follows. The pressure of fuel provided by fuel pump 22 through check valve 24 is regulated by fuel pressure regulator 26. Fuel pump 22 provides sufficient fuel flow such that fuel pressure regulator 26 can preferably regulate the pressure to about 55 to 65 psi. This relatively high pressure reduces the likelihood of fuel vapor formation in the fuel system. The fuel flows through fuel filter 34 and to fuel pressure damper 40. Fuel pressure damper 40 allows the fuel to flow to fuel rail 44 and fuel injectors 46.

As fuel injectors 46 open and close during their normal operation, fuel pressure pulsations can be generated in fuel rail 44, even to the point of creating standing waves. The pulsations can be a source of significant engine fueling errors, which can adversely affect the vehicle's performance and exhaust emission control. Further, these pulsations can under some circumstances be a source of audible noise as perceived by the persons in the vehicle. Therefore, fuel pressure damper 40 dampens these pulsations through appropriate deflection of main spring 120 in response to the pulsations.

The connection of port 48 of fuel pressure damper 40 to the intake manifold of the engine assures that any fuel and/or fuel vapor which may permeate past diaphragm assembly 100 will be burned in the engine, rather than escaping to atmosphere as evaporative emissions.

When fuel pump 22 is turned off, check valve 24 closes to maintain pressure in the system. This helps minimize fuel vaporization, enhancing hot restart ability. In the event that fuel pressure rises excessively during a hot soak, fuel pressure regulator 26 can open momentarily to relieve the excessive pressure.

It should be emphasized here that fuel pressure damper 40 is truly a damper, not a pressure regulator. That is, any steady-state variation in pressure at inlet 38 of fuel pressure damper 40 will be reflected at outlet 42; there is no "regulation" function performed. Fuel pressure damper 40 acts only to dampen transient pressure variations. Generally speaking, fuel pressure dampers have less-complicated designs, and are therefore less costly, than fuel pressure regulators.

An advantage of the present system should be emphasized here as well. Because in-line fuel filter 34 is located "downstream" from fuel pressure regulator 26, the only fuel filtered by fuel filter 34 is that fuel which is supplied to fuel injectors 46. This can be contrasted with a configuration in which fuel pressure regulator 26 were downstream of fuel filter 34. In that case, all fuel pumped by fuel pump 22, including fuel returned to the fuel tank by fuel pressure regulator 26, will be filtered by fuel filter 34. The present design, in which less fuel is filtered by fuel filter 34, will result in longer filter life.

Continue with reference to FIG. 1. Instead of fuel damper 40 being positioned "in series" with fuel flow to fuel injectors 46, a fuel pressure damper of alternative design can be mounted to various locations 128 on fuel rail 44. In those locations, the fuel pressure damper would be exposed to the pressure of fuel supplied to fuel injectors 46, but that fuel would not flow through the fuel pressure damper.

Figure 4:
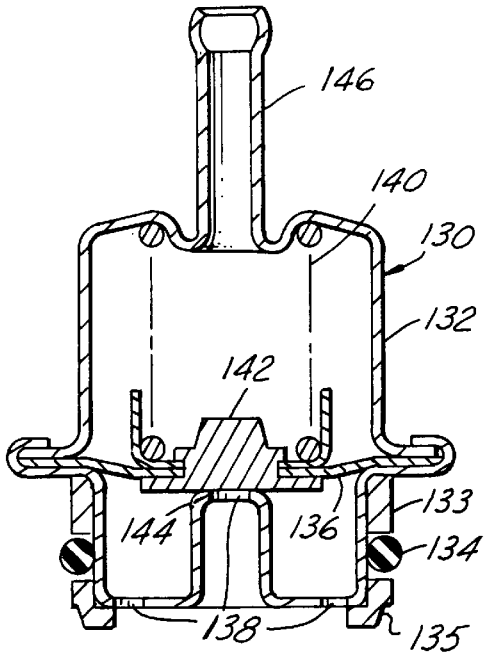
FIG. 4 is a cross-sectional view of an alternative fuel pressure damper 130.

One example of such an alternative design for a fuel pressure damper 130 is shown in FIG. 4. Here, fuel pressure damper 130 has a lower housing 132. Located on lower housing 132 is a plastic spacer 133, an O-ring 134 and a plastic end cap 135. End cap 135 may be snap-fit, press-fit or otherwise suitably fastened to lower housing 132. Lower housing 132 sits in an opening in fuel rail 44 (FIG. 1), with suitable retaining means holding fuel pressure damper 130 in place. O-ring 134 provides sealing to prevent fuel from escaping. The fuel pressure in fuel rail 44 acts on diaphragm assembly 136 through inlets 138. One skilled in the art will appreciate that there is no "outlet" to this fuel pressure damper 130. Main spring 140 acts in cooperation with diaphragm assembly 136 to dampen fuel pressure pulsations in fuel rail 44. As with fuel pressure damper 40 (FIG. 3), main spring 140 is compressed roughly halfway for the nominal fuel pressure in fuel rail 44. Further, for the normal operating pressure range in fuel rail 44, main spring 140 is neither fully compressed nor does body 142 contact rest 144. Fuel pressure damper 130 further has a port 146 coupled to the intake manifold (not shown) of the engine. This connection to the intake manifold causes all fuel and/or fuel vapor which permeates past diaphragm assembly 136 to be burned in the engine, rather than escaping to atmosphere as evaporative emissions.

Figure 5:
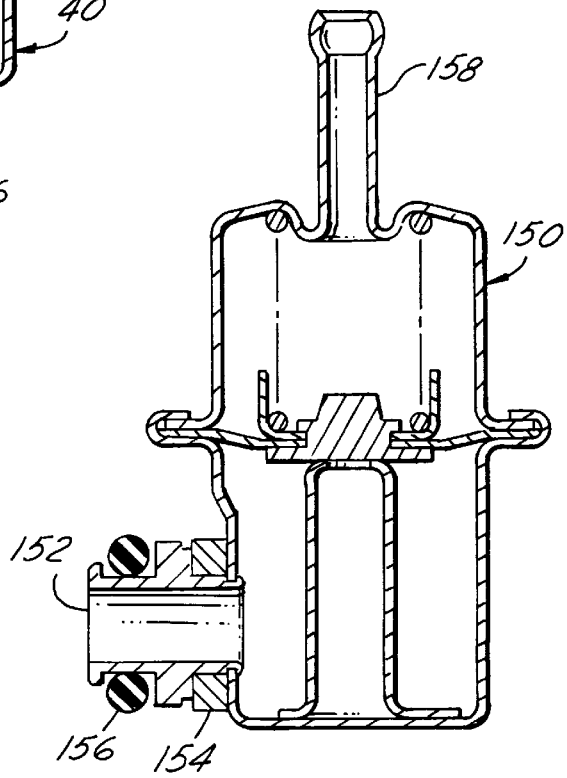
FIG. 5 is a cross-sectional view of another alternative fuel pressure damper 150.

A second example of a fuel pressure damper 150 which would mount at locations 128 is shown in FIG. 5. Here, instead of having inlets at the bottom, fuel pressure damper 150 has a side inlet 152. Fuel pressure damper 150 mounts to fuel rail 44 (FIG. 1) via mounting plate 154, with O-ring 156 preventing leakage from the joint between fuel pressure damper 150 and fuel rail 44. Port 158 is coupled to the intake manifold (not shown) of the engine.

Fuel delivery systems according to the present invention have been demonstrated to provide very precise fuel delivery and excellent NVH (noise/vibration/harshness) characteristics at a highly competitive system cost.

Various other modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting. The scope of the invention is instead defined by the following claims.

What is claimed is:

1. A fuel delivery system for a motor vehicle comprising:

a fuel pump;

at least one fuel injector;

fuel delivery passage means for delivering fuel provided by said fuel pump to said at least one fuel injector;

a fuel pressure regulator coupled to said fuel delivery passage means; and a fuel pressure damper coupled to said fuel delivery passage means downstream of said fuel pressure regulator;

wherein said vehicle has a fuel tank and said fuel pressure regulator is located within said fuel tank.

2. A fuel delivery system as recited in claim 1 wherein said at least one fuel injector is mounted in a fuel rail and said fuel pressure damper is mounted to said fuel rail.

3. A fuel delivery system as recited in claim 2 wherein said fuel pressure damper is mounted in series with fuel flow to said at least one fuel injector.

4. A fuel delivery system as recited in claim 3 wherein said fuel pressure damper further comprises:

a diaphragm assembly defining a first chamber and a second chamber;

an inlet passage having a first end and a second end, said first end forming an inlet of said fuel pressure damper and said second end disposed within said first chamber;

a spring biasing said diaphragm assembly toward said second end of said inlet passage;

an outlet in fluid communication with said lower chamber;

wherein said spring is selected such that for all normal operational fuel pressures of said system at said outlet, said diaphragm assembly remains displaced from said second end of said inlet passage such that said spring acts to dampen excursions in fuel pressure at said outlet.

5. A fuel delivery system as recited in claim 4 wherein said at least one fuel injector is mounted in a fuel rail and said fuel pressure damper is mounted to said fuel rail.

6. A fuel delivery system as recited in claim 5 further comprising a fuel filter mounted in said fuel delivery passage means at a point downstream of said fuel pressure regulator.

7. A fuel delivery system as recited in claim 1 further comprising a fuel filter mounted in said fuel delivery passage means at a point downstream of said fuel pressure regulator.

8. A fuel delivery system as recited in claim 2, wherein said fuel pressure damper further comprises:

a diaphragm assembly defining a first chamber and a second chamber;

a rest disposed in said first chamber and in opposition to said diaphragm assembly;

a main spring located in said second chamber and biasing said diaphragm assembly toward said rest;

wherein said first chamber is in continuous fluid communication with fuel in said fuel rail; and wherein said spring is selected such that for all normal operational fuel pressures of said system in said fuel rail, said diaphragm assembly remains displaced from said rest such that said spring acts to dampen excursions in fuel pressure in said fuel rail.

9. A fuel delivery system as recited in claim 8 further comprising a fuel filter mounted in said fuel delivery passage means at a point downstream of said fuel pressure regulator.

10. A fuel delivery system for a motor vehicle comprising:

a fuel tank;

a fuel pump located within said fuel tank;

at least one fuel injector;

fuel delivery passage means for delivering at least some fuel pumped by said fuel pump to said at least one fuel injector;

a fuel bypass passage coupled to said fuel delivery passage means and terminating in said fuel tank;

a fuel pressure regulator disposed in said fuel tank to discharge, into said fuel bypass passage, fuel pumped by said fuel pump and not delivered to said at least one fuel injector; and a fuel pressure damper coupled to said fuel delivery passage means downstream of where said fuel bypass passage is coupled to said fuel delivery passage means.

11. A fuel delivery system as recited in claim 10, further comprising a fuel filter coupled in said fuel delivery passage means downstream from said point to which said fuel bypass passage is coupled.

12. A fuel delivery system as recited in claim 11, wherein said fuel pressure damper is coupled in series with fuel flow in said fuel delivery passage means.

13. A fuel delivery system as recited in claim 12, wherein said fuel pressure damper further comprises:

a diaphragm assembly defining a first chamber and a second chamber;

an inlet passage having a first end and a second end, said first end forming an inlet of said fuel pressure damper and said second end disposed within said first chamber;

a spring biasing said diaphragm assembly toward said second end of said inlet passage;

an outlet in fluid communication with said lower chamber;

wherein said spring is selected such that for all normal operational fuel pressures of said system at said outlet, said diaphragm assembly remains displaced from said second end of said inlet tube such that said spring acts to dampen excursions in fuel pressure at said outlet.

14. A fuel delivery system as recited in claim 13, wherein:

said system further comprises a fuel rail, said fuel injectors mounted in said fuel rail; and said fuel pressure damper is coupled to said fuel rail.

15. A fuel delivery system as recited in claim 11, wherein:

said system further comprises a fuel rail, said fuel injectors mounted in said fuel rail; and said fuel pressure damper is coupled to said fuel rail.

16. A fuel delivery system as recited in claim 15, wherein said fuel pressure damper further comprises:

a diaphragm assembly defining a first chamber and a second chamber;

a rest disposed in said first chamber and in opposition with said diaphragm assembly;

a main spring located in said second chamber and biasing said diaphragm assembly toward said rest;

wherein said first chamber is in continuous fluid communication with fuel in said fuel rail; and wherein said spring is selected such that for all normal operational fuel pressures of said system in said fuel rail, said diaphragm assembly remains displaced from said rest such that said spring acts to dampen excursions in fuel pressure in said fuel rail.

* * * * *